US007239819B2

(12) United States Patent
Gross et al.

(10) Patent No.: US 7,239,819 B2
(45) Date of Patent: Jul. 3, 2007

(54) TONE REPRODUCTION CURVE (TRC) TARGET ADJUSTMENT STRATEGY FOR ACTUATOR SET POINTS AND COLOR REGULATION PERFORMANCE TRADE OFF

(75) Inventors: Eric M. Gross, Rochester, NY (US); Fan Shi, Penfield, NY (US); Mark S. Jackson, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 314 days.

(21) Appl. No.: 11/117,545

(22) Filed: Apr. 29, 2005

(65) Prior Publication Data

US 2006/0245773 A1 Nov. 2, 2006

(51) Int. Cl.
*G03G 15/00* (2006.01)

(52) U.S. Cl. ..... 399/49; 399/53

(58) Field of Classification Search ..... 399/38, 399/42, 46, 49, 53, 72
See application file for complete search history.

(56) References Cited

U.S. PATENT DOCUMENTS 6,694,109 B1 * 2/2004 Donaldson et al. ..... 399/49
6,697,582 B1 * 2/2004 Scheuer ..... 399/49
6,741,816 B2 * 5/2004 Shim et al. ..... 399/49

* cited by examiner

*Primary Examiner*—Hoan Tran
(74) *Attorney, Agent, or Firm*—Oliff & Berridge, PLC

(57) ABSTRACT

A method of controlling an actuator includes determining a function of an actuator value based on a cost function index that represents a relationship between a tone reproduction curve error and the actuator value necessary to achieve a tone reproduction curve target, determining an actual tone reproduction curve error from an obtained sample of a tone reproduction curve and controlling the actuator based on the function and actual tone reproduction curve error to move to a point that represents the tone reproduction curve target. A Xerographic system includes an actuator, an input device that inputs the cost function index and a controller that controls the Xerographic system to obtain the sample, determine an actual tone reproduction curve error from the sample, and control the actuator based on the cost function index and the actual tone reproduction curve error to move to a point that represents the tone reproduction curve target.

20 Claims, 11 Drawing Sheets

TONE REPRODUCTION CURVE (TRC) TARGET ADJUSTMENT STRATEGY FOR ACTUATOR SET POINTS AND COLOR REGULATION PERFORMANCE TRADE OFF

BACKGROUND

1. Field of Invention

Actuator systems and methods that control printing systems by adjusting tone reproduction curve targets using real-time feedback control.

2. Description of Related Art

In copying or printing systems such as a Xerographic copier, laser printer or inkjet printer, a common technique for monitoring the quality of prints is to artificially create a test patch of a predetermined desired density. The actual density of the printing material, toner or ink for example, in the test patch can then be optically measured to determine the effectiveness of the printing process to place the correct quantity of material on the printed sheet.

With laser printers, a charge retentive surface or photoreceptor is used to form an electrostatic latent image that causes toner particles to adhere to areas on the surface that are charged in a particular way. An optical device, often referred to as a densitometer, may be used for determining the density of toner on the test patch (that can assume halftone levels from 0 to 100%) along the path of the photoreceptor and directly downstream of the development unit. The printing system may perform a process to periodically create test patches at the desired halftone levels at predetermined locations on the photoreceptor by deliberately actuating the exposure system.

The electrostatic latent test patch is then moved past a developer unit. Toner particles within the developer unit are caused to adhere to the test patch electrostatically. The developed test patch is moved past the densitometer disposed along the path of the photoreceptor and the specular reflectance and or diffuse reflectance of the test patch is measured. The density of toner on the patch varies in relationship to both the specular reflectance and diffuse reflectance of the test patch.

Xerographic test patches that are used to measure the deposition of toner on the photoreceptor, and thereby regulate the deposition of toner onto paper and control the tone reproduction curve (TRC) are traditionally printed in interdocument zone regions of photoreceptor belts or drums. Generally, each patch is a small square that is printed at a predefined halftone level. This practice enables the sensor to infer the TRC. The number of patches to monitor and regulate can range from 1 to the full number of halftone levels the system is capable of addressing.

Many Xerographic printing system process control systems adjust physical actuators such as developer bias, charge level and raster output scanner (ROS) intensity to maintain the TRC as measured by an in-line optical sensor. In the example presented here the controls maintain the TRC at three control points, though more or less control points can be used. Currently, there are insufficient actuators and insufficient latitude to control the entire TRC to the desired accuracy across the expected set of disturbances anticipated in a customer environment. The variation can cause objectionable color changes, especially in overlay colors that are printed using more than one of the printer primary colors.

Accordingly, because of the difficulty in monitoring and controlling the toner development process, various approaches have been devised.

U.S. Pat. No. 5,963,244 to Mestha et al. discloses sensing the TRC at discrete intervals and doing a least squares fit to project an entire TRC. The tone reproduction curve is recreated by providing a look-up table for reconstruction of the TRC. The look-up table incorporates a co-variance matrix of elements containing end-tone reproduction samples. The matrix multiplier responds to sensed developed patch samples and to the look-up table to reproduce a complete tone reproduction curve. A controller reacts to the reproduced tone reproduction curve to adjust machine quality.

U.S. Pat. No. 5,749,020 to Mestha et al. discloses TRC variations using a set of orthogonal basis functions. The basis functions are derived by decomposing sample tone reproduction curves to provide a predicted tone reproduction curve. The predicted tone reproduction curve is melded with a discrete number of tone reproduction samples to produce a reconstructed TRC for machine control.

U.S. Pat. No. 6,035,152 to Craig et al. discloses a method for measuring tone reproduction curves. A setup calibration TRC is generated based on preset representative halftone patches. A test pattern including a plurality of halftone patches is marked in the inter-document zone of the imaging surface. A relative reflection of each of the halftone patches is entered into a matrix and the matrix is correlated to a plurality of print quality actuators. A representative TRC is generated based on the matrix results. A feedback signal is produced by comparing the representative TRC to the setup calibration tone curve and each of the print quality actuators is adjusted independently to adjust printing machine operation for print quality correction.

U.S. Pat. No. 5,777,656 to Henderson discloses using lookup tables to adjust a measured TRC to match a target TRC. The method of maintaining tone reproduction for printing includes the steps of marking representative halftone targets on an imageable surface with toner sensing an amount of toner on each of the representative halftone targets, generating a representative TRC based on the sensed amount of toner on the representative halftone targets, producing a feedback signal generated by comparing a representative TRC to a setup calibration tone curve and adjusting pixel data of each pixel of the final halftone image to compensate for deviation between the representative TRC and the setup calibration tone curve.

U.S. Pat. No. 5,649,073 to Knox et al. discloses a method and apparatus for calibrating gray reproduction schemes for use in a printer. The calibration system includes a test pattern stored in a memory and providing a plurality of samples of combinations of printed spots printable on a media by the printer. A gray measuring device is included to derive a gray measurement of the samples of printed spots. A calibration processor correlates the gray measurements with a combination of spots having a particular spatial relationship and derives parameters describing the printer response to the combination. The calibration processor generates from the derived parameters at least one non-linear gray image correction function then stores the generated gray image function calibration in a calibration memory. A means is provided to apply the gray image correction stored in the calibration memory to calibrate a printer using a halftone pattern.

U.S. Pat. No. 5,612,902 to Stokes discloses a method and system for automatically characterizing a color printer. A relatively few number of test samples are printed and measured to create an analytic model which characterizes a printer. The analytical model is used in turn to generate a multi-dimensional look-up table that can then be used at one time to compensate image input and create a desired visual characteristic in the printed image.

Because of the potential near-degeneracy, e.g., ill-conditioned behavior, of the TRC response to actuator adjustments, Xerographic conditions arise under which holding fixed test patch targets can require driving the xerographic actuators to their limiting values. As discussed above, deadbanding has been introduced to mitigate these problems. However, while deadbanding can reduce the likelihood of forced excursions, deadbanding treats all actuator levels equally and does not adjust the actuators to preferable values while satisfying the constraint to keep the TRC within the specified dead band. Undesirable actuator levels may continue to be used because there is no restoring function to recenter the undesirable actuator level once within the deadband. Undesirable actuator levels are those that result in image quality defects that are not embodied by the TRC (even though the TRC is maintained close to target). Current systems can also exhibit increased color variability even under Xerographic conditions that would normally permit tight control to the TRC patch targets.

SUMMARY

Based on the problems discussed above, there is a need for a TRC target adjustment strategy to trade off actuator set points and TRC color regulation performance by providing an improved real-time control algorithm.

A method may manage actuator levels by intentional adjustment of TRC targets. This process may be used instead of allowing random variation within a deadband. The process may also enable improved color control by determining a range of Xerographic noise levels that allows the actuators to be used at levels that do not exacerbate other image quality defects, that is that manage a tradeoff between TRC performance and actuator levels when Xerographic noises do not permit the actuators to be at the desired levels. The algorithm then returns to a tight TRC color control when noise levels change and again permit a return to acceptable actuator levels.

A method of controlling an actuator includes determining a function of an actuator value based on a cost function index that represents a relationship between a tone reproduction curve error and the actuator value necessary to achieve a tone reproduction curve target, determining an actual tone reproduction curve error from an obtained sample of a tone reproduction curve and controlling the actuator based on the function and actual tone reproduction curve error to move to a point that represents the tone reproduction curve target.

A Xerographic system includes an actuator, an input device that inputs the cost function index and a controller that controls the Xerographic system to obtain the sample, determine an actual tone reproduction curve error from the sample, and control the actuator based on the cost function index and the actual tone reproduction curve error to move to a point that represents the tone reproduction curve target.

The Xerographic system may be used to print an image on a receiving medium using a charge retentive surface.

BRIEF DESCRIPTION OF THE DRAWINGS

Various exemplary embodiments of the systems and methods will be described in detail, with reference to the following figures, wherein.

DETAILED DESCRIPTION OF EMBODIMENTS

Figure 1:
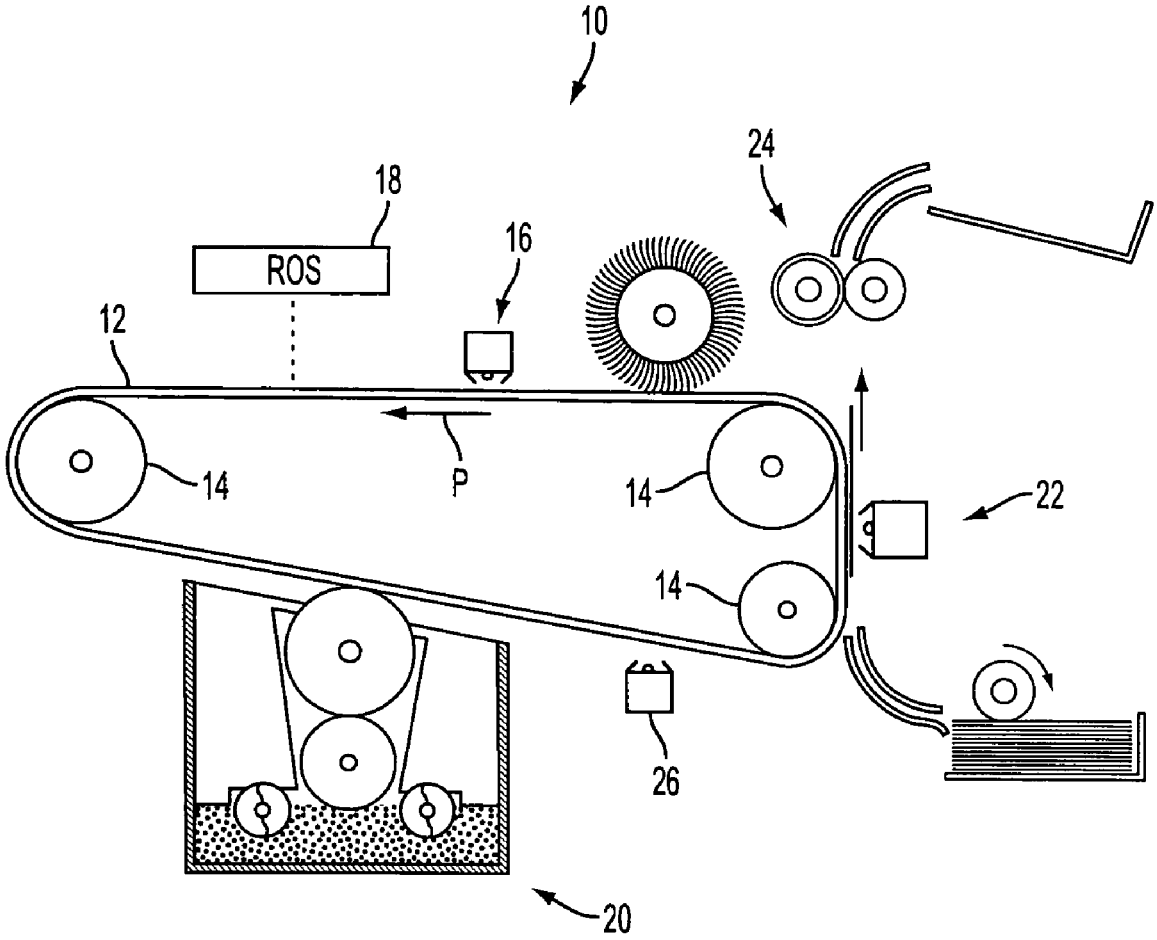
FIG. 1 is an exemplary diagram showing an electrophotographic machine incorporating tone reproduction curve control.

FIG. 1 is an exemplary diagram of a printing system 10 that includes a photoreceptor 12 which may be in the form of a belt or drum and which includes a charge retention surface. The photoreceptor 12 may be entrained on a set of rollers 14 and caused to move in a counter-clockwise process direction by means such as a motor (not shown).

A printing process such as an electrophotographic process must charge the relevant photoreceptor surface. The initial charging may be performed by a charge source 16. The charged portions of the photoreceptor 12 may then be selectively discharged in a configuration corresponding to the desired image to be printed by a raster output scanner (ROS) 18. The ROS 18 may include a laser source (not shown) and a rotatable mirror (also not shown) acting together in a manner known in the art to discharge certain areas of the charged photoreceptor 12. It should be appreciated that other systems may be used for this purpose including, for example, an LED bar or a light lens system instead of the laser source. The laser source may be modulated in accordance with digital image data fed into it and the rotating mirror may cause the modulated beam from the laser source to move in a fast scan direction perpendicular to the process direction of the photoreceptor 12. The laser source may output a laser beam of sufficient power to charge or discharge the exposed surface on photoreceptor 12 in accordance with a specific machine design.

After selected areas of the photoreceptor 12 are discharged by the laser source, remaining charged areas may be developed by developer unit 20 causing a supply of dry toner to contact the surface of photoreceptor 12. The developed image may then be advanced by the motion of photoreceptor 12 to a transfer station including a transfer device 22, causing the toner adhering to the photoreceptor 12 to be electrically transferred to a substrate, which is typically a sheet of paper, to form the image thereon. The sheet of paper with the toner image may then pass through a fuser 24, causing the toner to melt or fuse into the sheet of paper to create a permanent image.

TRC regulation performance can be quantified by measuring the halftone area density, (i.e., the copy quality of a representative area), which is intended to be, for example, fifty percent (50%) covered with toner. The halftone is typically created by virtue of a dot screen of a particular resolution and, although the nature of such a screen will have a great effect on the absolute appearance of the halftone, any common halftone may be used. Both the solid area and halftone density may be readily measured by optical sensing systems that are familiar in the art.

As shown in FIG. 1, a densitometer 26 may be used after the developing step to measure the optical density of the halftone density test patch created on the photoreceptor 12 in a manner known in the art. As used herein, the densitometer is intended to apply to any device for determining the density of print material on a surface, such as a visible light densitometer, an infrared densitometer, an electrostatic voltmeter, or any other such device that makes a physical measurement from which the density of print material may be determined.

Figure 2:
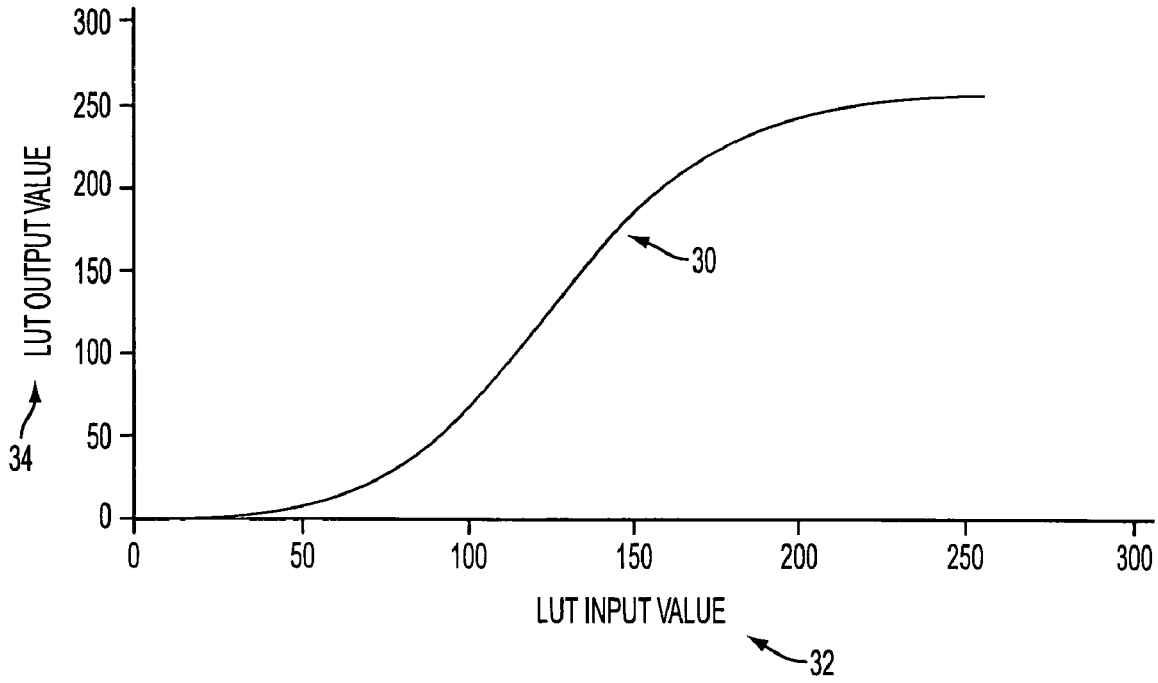
FIG. 2 is an exemplary diagram of a tone reproduction curve.

When the laser source causes spots of a certain size to be deposited, the spots may become somewhat enlarged when developed. If the spots are developed at exactly the same size as the deposited spots, then perfect size reproduction would be possible, wherein the TRC would be a straight line. However, because of the undesirable spot enlargement, the TRC takes on the form of a curve. FIG. 2 shows an exemplary diagram of one possible TRC that may be used in order to produce the desired output density. In order to maintain a TRC at its desired configuration, voltage levels within the printing system 10 may be changed in order to produce a desirable TRC. For example, development potential, photoreceptor or drum charge level, and laser power may be modified in order to maintain the desired curve.

Figure 3:
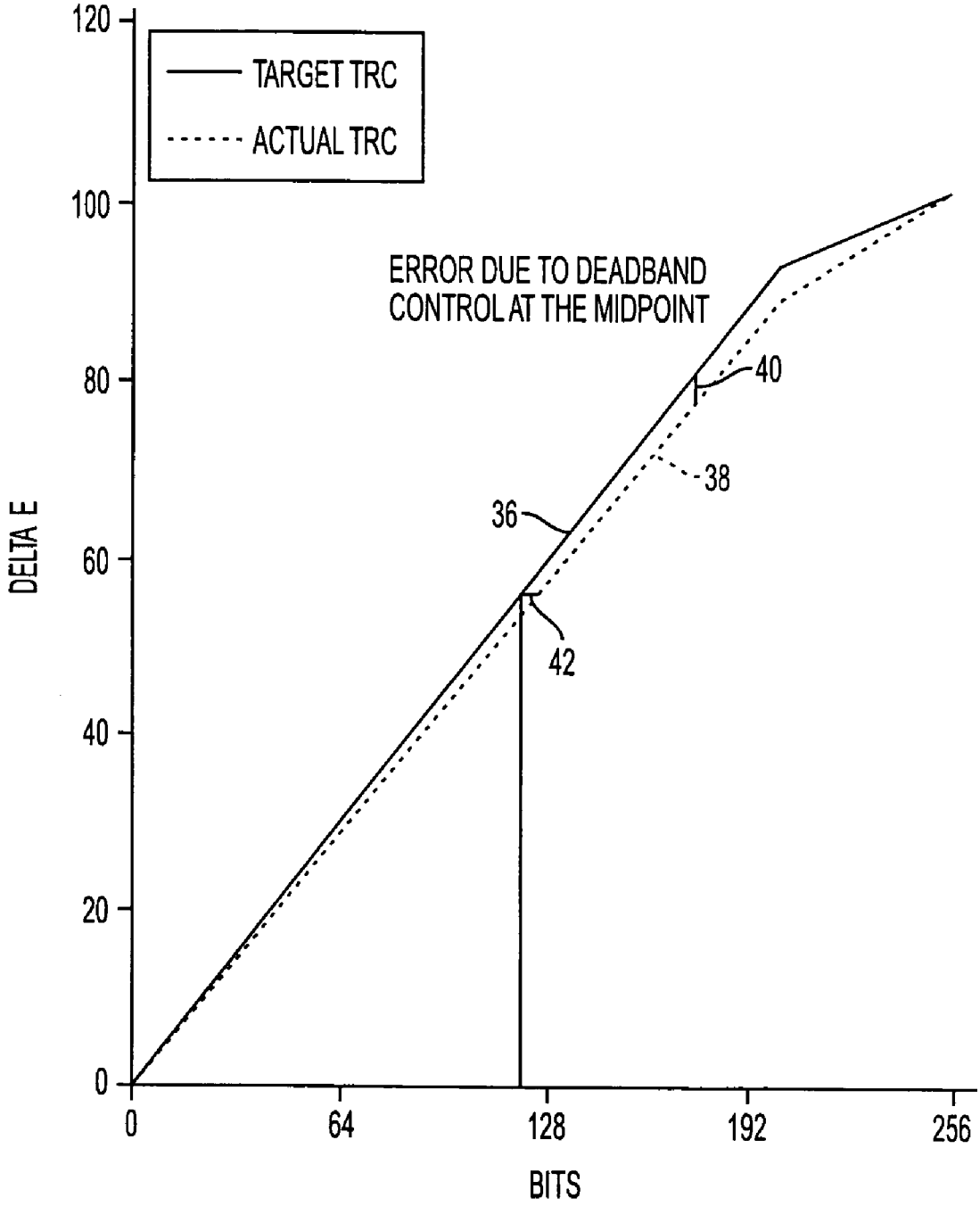
FIG. 3 is an exemplary diagram showing a sample TRC variation from a target TRC.

FIG. 2 provides a visual representation of a TRC 30 implemented in the form of a look-up table (LUT). As shown in FIG. 2, an input C, M, Y or K value may be found on the horizontal LUT input value axis 32. A vertical line from the determined position on the horizontal axis intersects the TRC curve 30 at a point that determines the LUT output value 34 in terms of C, M, Y or K as read from the vertical axis. Utilizing the afore-mentioned controls, electrostatic actuators such as development potential, photoreceptor charge level, and laser power intensity can be adjusted to stabilize the TRC may provide reasonable results FIG. 3 is an exemplary diagram showing an actual TRC variation from a target TRC. As shown in FIG. 3, the variation is due to error caused by deadband control at the midpoint and a method for reducing actuator variation. Actual TRC 36 varies from target TRC 38 by an amount characterized as deltaE, common in the art, and shown as numeral 40 in FIG. 3. The error may be compensated by printing a halftone density that is adjusted from a desired halftone density by a correction amount 42 such that the developed halftone density matches the requested halftone density. For example, an image might require a halftone density of 128 bits and, as shown in FIG. 3, reducing the requested 128 bits by correction factor 42 of 6 bits and printing a 122 bit density, results in a developed halftone equal to the original requested 128 bit halftone. Implementing this error correction method results in halftone color print errors of about 3 deltaE or less. However, as discussed above, deadbanding does not trade off undesirable actuator levels against TRC control accuracy, even if setting closer to the desired actuator levels yields less TRC control error. There is no restoring function to recenter to or near the desirable actuator levels while remaining within the dead band.

Generally TRC control is a multi-input and multi-output system. Singular value decomposition may be used to decouple linear systems into orthogonal actuators and responses. A process to manage low gain actuators by intentional variation of TRC targets may then be applied to each loop separately. The loop with the least actuator latitude to compensate for expected disturbances (e.g., the weak direction, as defined by the loop with the largest ratio of some disturbance magnitude to actuator gain) may be a primary candidate for applying this technique.

Figure 4:
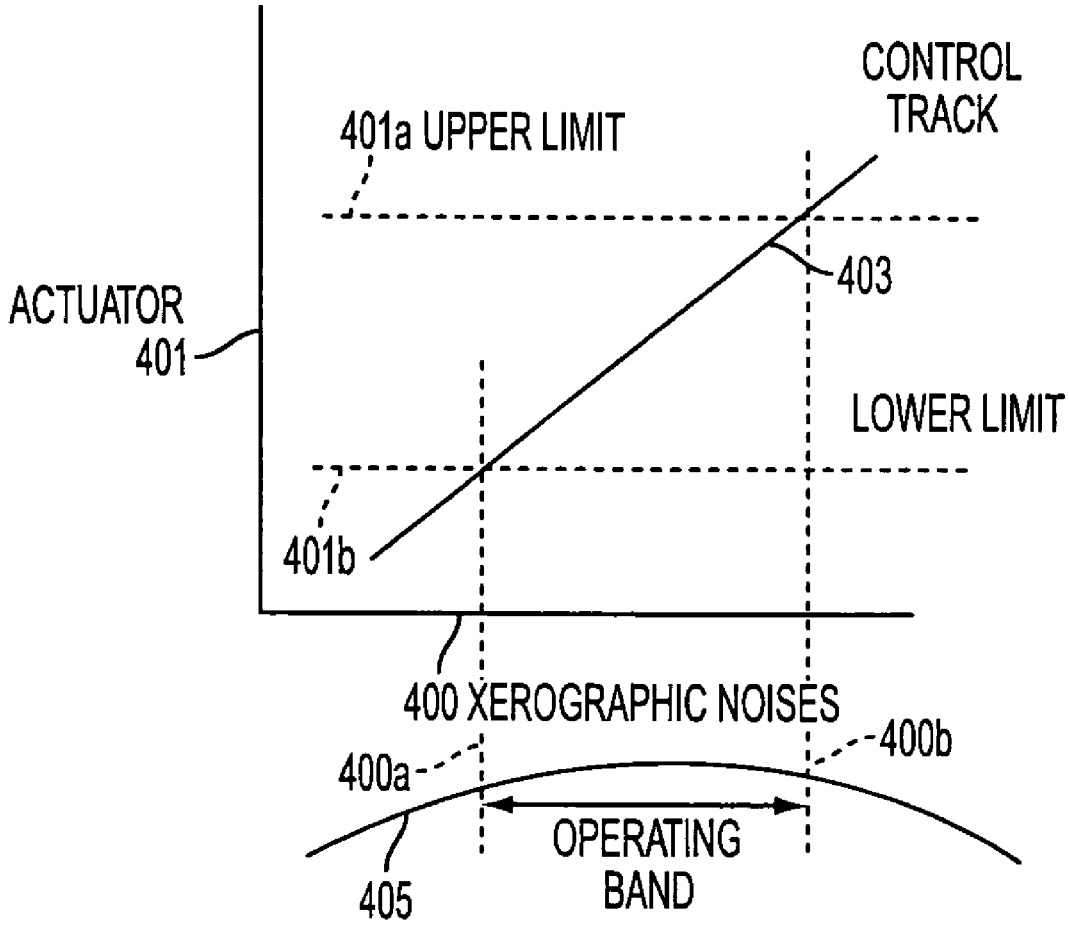
FIG. 4 is an exemplary graph showing control of a TRC without deadbanding.

FIG. 4 is an exemplary graph showing process control of a TRC without deadbanding. As shown in FIG. 4, the weak direction is represented by the graph. The x-axis 400, e.g., Xerographic noises, may combine all mechanical, materials, and environmental variation into a single variable aligned with the actuator response necessary to maintain a single fixed TRC (color) target. This method may permit linking the actuator 401 level with the Xerographic noises through a control track 403, e.g., a centerline, as shown in FIG. 4.

The limited range 401*a*-401*b* of the actuator 401 and the control track 403 together help define a band 400*a*-400*b* of Xerographic noise in which a printing system may operate. The curve 405 across the bottom of FIG. 4 represents the distribution of Xerographic noises actually encountered. When the distribution is broader than the operating band 400*a*-400*b*, as shown in FIG. 4, the result is large swings in actuator values, an inability to converge to the TRC target, and poorly controlled operation at the actuator rail.

Figure 5:
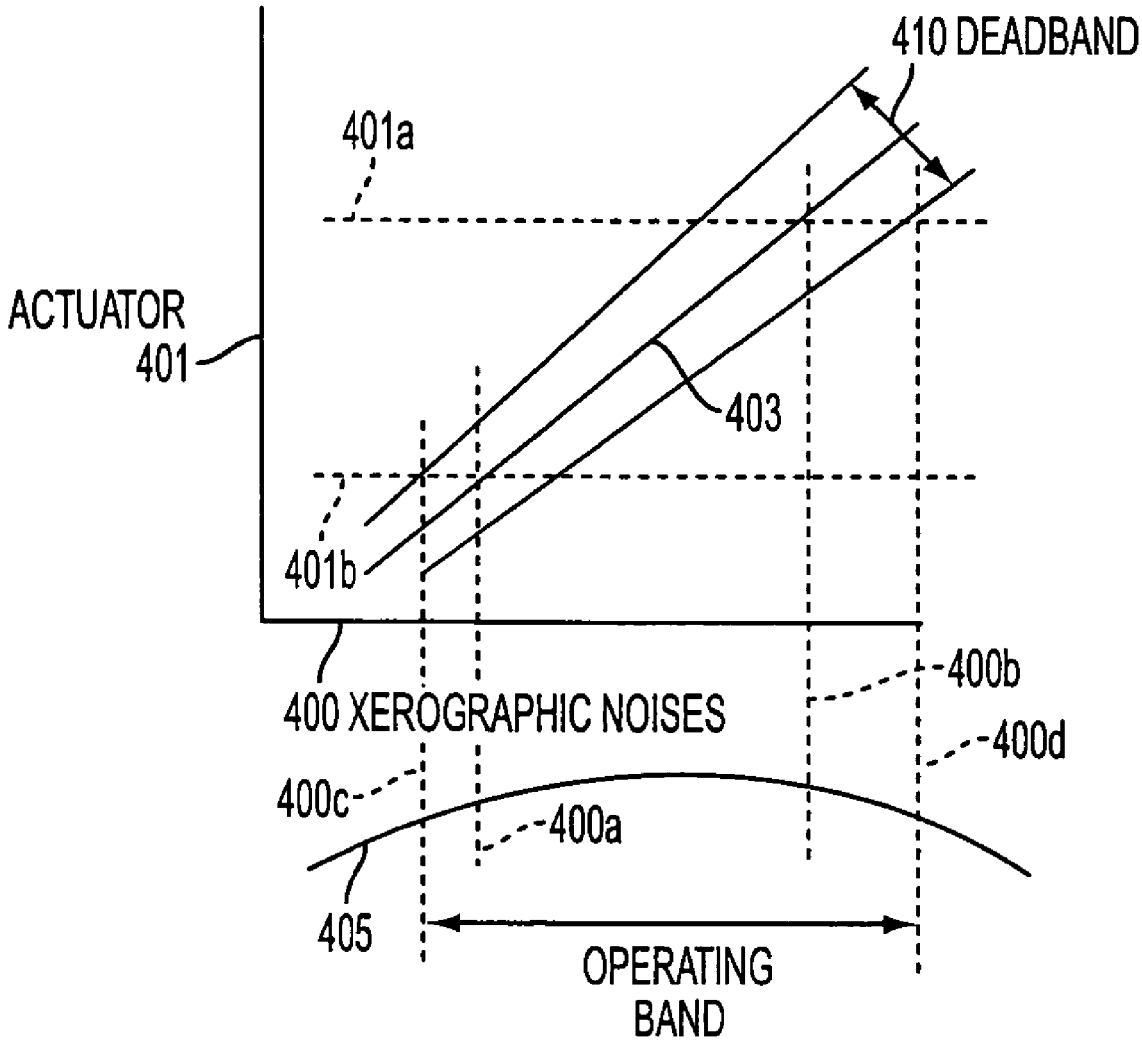
FIG. 5 is an exemplary graph showing control of a TRC with deadbanding.

FIG. 5 is an exemplary graph showing control of a TRC by applying a deadbanding zone 410 around the TRC target(s). By relaxing the control conditions, the printing system may accommodate a wider operating band 400*c*-400*d* of Xerographic noises. As a result, it is possible to use a wider swing in the Xerographic noise to drive the printing system to extreme actuator values.

Extreme actuator values may have to be applied to compensate for Xerographic noises. However, if the actuator is driven to an extreme actuator value, the printing system will remain there unless there is a significant noise change in the opposite direction. This situation may compromise color control over the entire noise space. Even under conditions that permit operation at the original target with reasonable actuator values, the actual TRC reading may be located anywhere within the deadband zone 410. Thus, it would be advantageous to manage the TRC target as a function of actuator value rather than permitting the printing system to wander in a history-dependent manner within the deadband zone 410.

Figure 6:
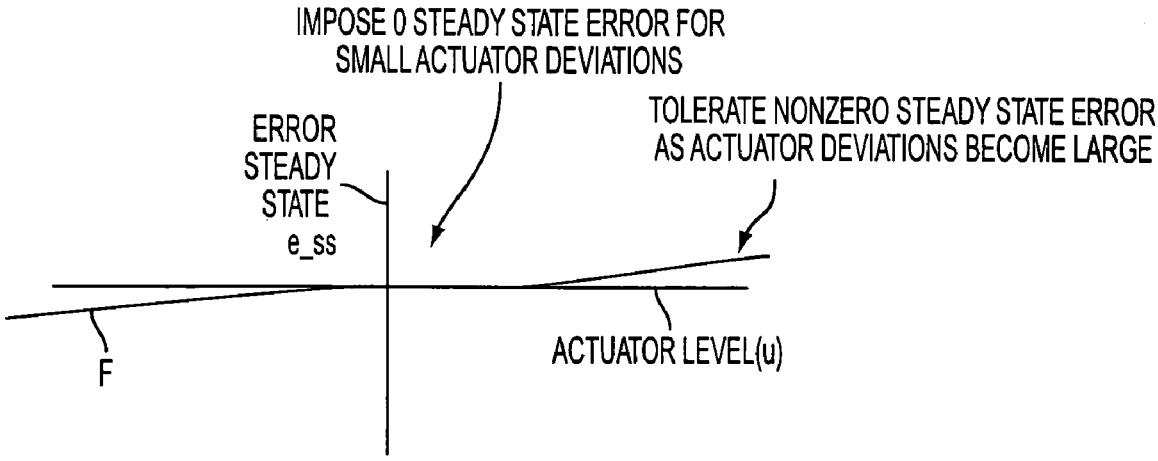
FIG. 6 is an exemplary graph showing a tradeoff between error steady state and actuator level.

FIG. 6 is an exemplary graph showing a tradeoff between error steady state and actuator level. A steady-state error variable E_ss is shown in FIG. 6. The tradeoff between E_ss and an actuator level (u) may be embodied in a selection of a function F( ), Error_Steady_State=F (Actuator). The term d indicates the disturbance or noise variable. The tradeoff assumes it is better to accept some non-zero steady state error at certain actuator levels than to move the actuators large amounts to achieve zero steady state error. The tradeoff is based on the assumption that the TRC regulation error itself is not fully representative of the printing system performance. For example, zero error at a high actuator level may achieve zero steady state error between the TRC and target TRC, but a high actuator level may exacerbate non-uniformity (which is not directly measured in real time). FIG. 6 shows an example of the tradeoff function F—the form of which can be selected with knowledge of the engineering benefits and costs for the specific situation. The process imposes a zero steady state error for small actuator deviations, and tolerates nonzero steady state error as actuator deviations from desired levels increase.

Figure 7:
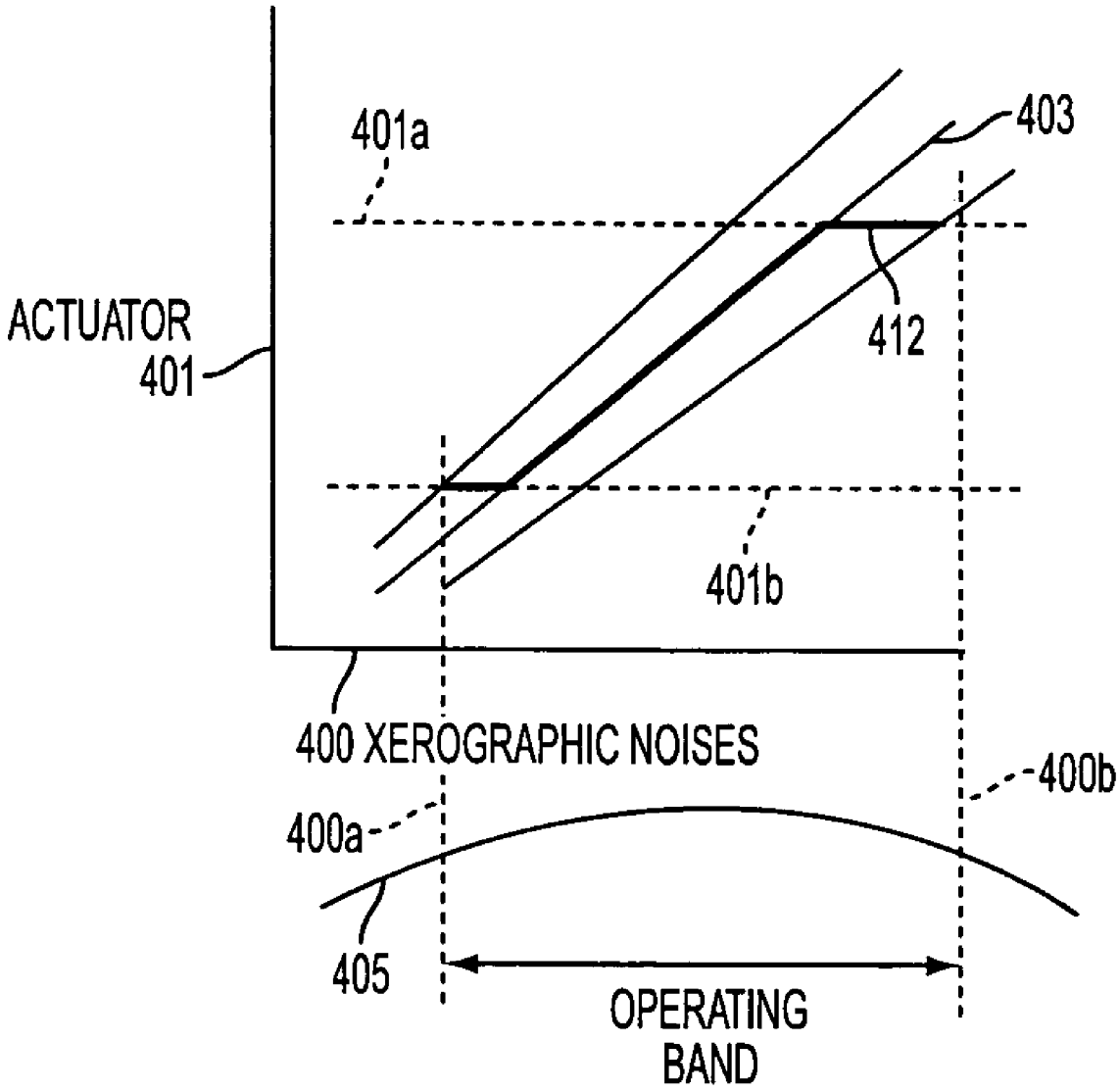
FIG. 7 is an exemplary graph showing an embodiment of actuator control.

FIG. 7 is an exemplary graph showing an embodiment of actuator control. When the tradeoff is determined, F(u) is defined because, at a steady state, E_ss=F(u). The steady state behavior may be plotted as E_ss versus d, and u versus d. The relationships are defined once F(u) is defined and with the assumption that the printing system output model is adequately described by u* (System Model)+d, where System Model is a gain, possibly slowly varying in time.

There is a wide range of functions F(u) that may yield a stable loop. For example, if the control is a pure integrator (as discussed above) with positive gain C, System Model is a positive gain of K, and the actuator signal u is bounded, then all other signals internal to the loop are bounded. This example may be shown by the following stability proof based on the common in the art Lyaponov methodology:

$$V=\tfrac{1}{2}*u\hat{}2, \text{ then } dV/dt=u*du/dt.$$

It follows that:

$$dV/dt=u*[-C*(Ku+F(u))]=-C*(Ku\hat{}2+uF(u)),$$

so for F(u) such that Ku^2+uF(u)>0, system stability is assured since V>=0 and dV/dt<0. In fact, stability is assured for any F(u) such that for u>0, F(u)>−Ku and for u<0, F(u)<−Ku.

When color stability is a top priority, (e.g., color stability will only be compromised when necessary to permit continued operation), then F(u) 412 as shown in FIG. 7 may be controlled to hold the TRC target fixed until the actuator 401 approaches the upper 401*a* or lower 401*b* limits. The target may be subsequently adjusted rapidly toward an outermost acceptable limit 400*a* or 400*b* of Xerographic noise. This adjustment results in the graph shown in FIG. 7.

Figure 8:
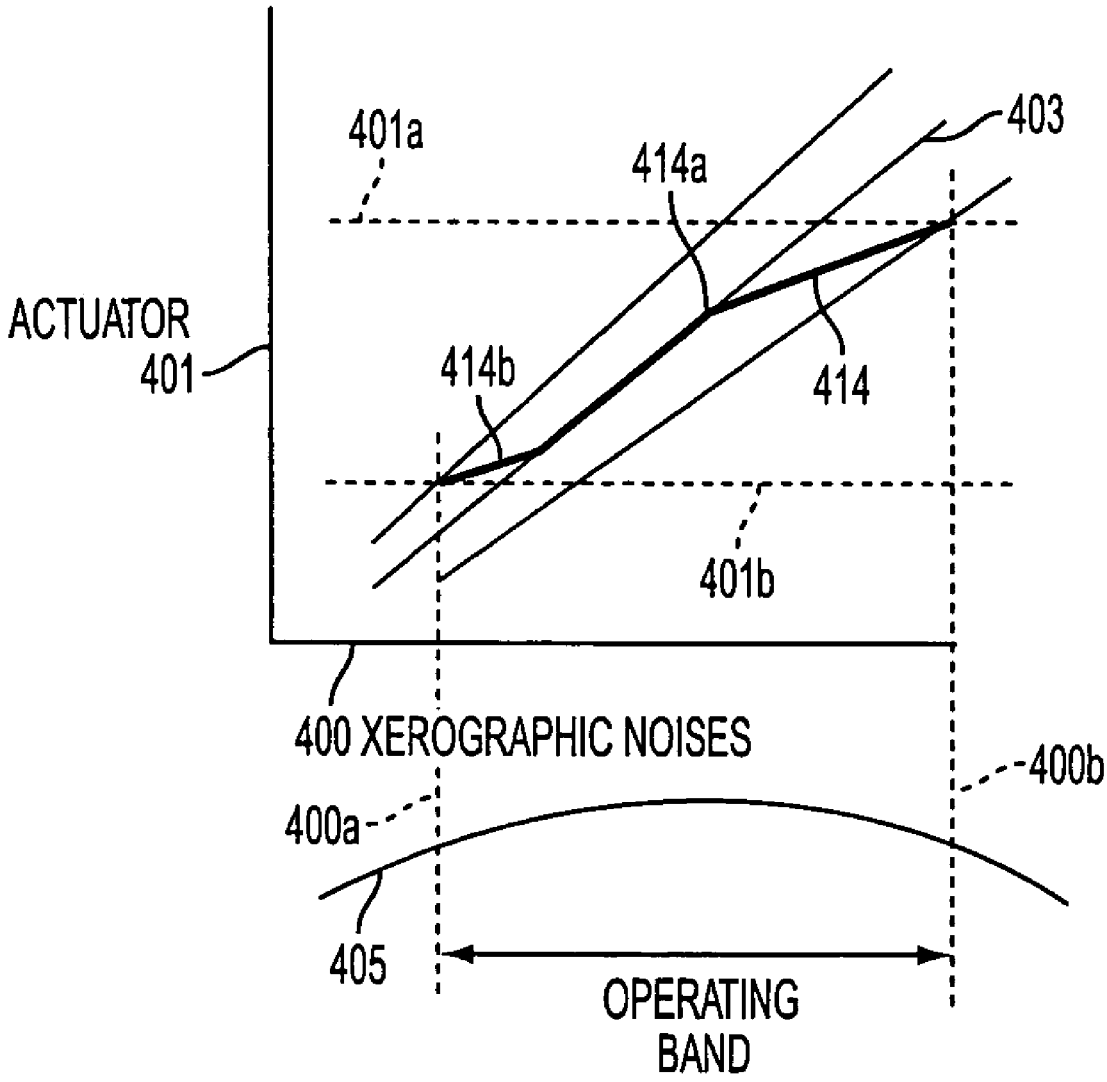
FIG. 8 is an exemplary graph showing another embodiment of actuator control.

FIG. 8 is an exemplary graph showing another embodiment. As shown in FIG. 8, a predetermined range 441*a*-414*b*, e.g., an acceptable range of actuator levels, for the actuator 401 is determined so that values above and below the predetermined range 441*a*-414*b* are considered unacceptable even though the actuator values may be within the physical upper 401*a* and lower 401*b* limits of the actuator. Such extreme actuator values, for example, may be associated with elevated within-page nonuniformities. The tradeoff color stability could then be selected in order to reduce actuator variation. F(u) (shown as 414 in FIG. 7) may be controlled toward the outermost acceptable limits 400*a* or 400*b* of Xerographic noise prior to the actuator reaching the upper 401*a* or lower 401*b* limits of the actuator 401.

FIG. 8 shows the results of this method of control. The color is closely controlled until the actuator passes the predetermined range 441*a*-414*b* as the upper and lower limit of the desired actuator range. The control target is then smoothly varied away from its control track 403 in order to reduce the actuator variation. This method may be used to set safety limits within the upper and lower limits of the actuator to prevent the actuator from being driven to an unacceptable level, and the printing system from remaining at the extreme actuator value until there is a significant noise change in the opposite direction.

Figure 9:
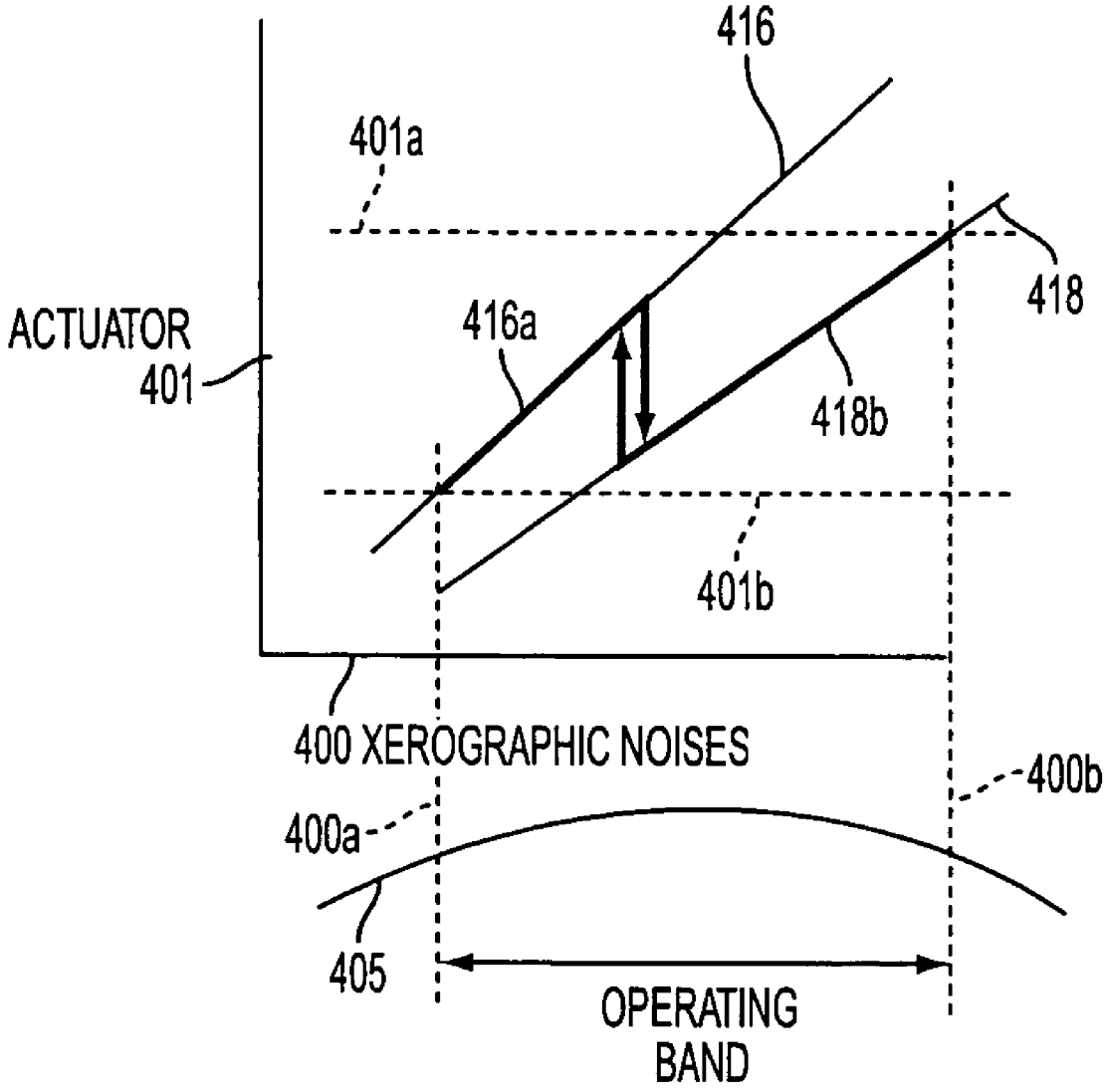
FIG. 9 is an exemplary graph showing another embodiment of actuator control.

FIG. 9 is an exemplary graph showing another embodiment of actuator control. As shown in FIG. 9, two different color targets may be used to maintain the actuator within a tight range. The color calibrations are obtained for a particular printing system and the calibrations are preset as targets that correspond to control tracks 416 and 418. A control method may then be implemented that switches between the control tracks 416 and 418 (and associated color correction tables) depending on the actuator value. This control method is shown as tracks 416*a* and 418*b*. Hysteresis may be used to control the actuator as shown to avoid instability. By using the method shown in FIG. 9, the actuator may tolerate an error on the TRC.

Figure 10:
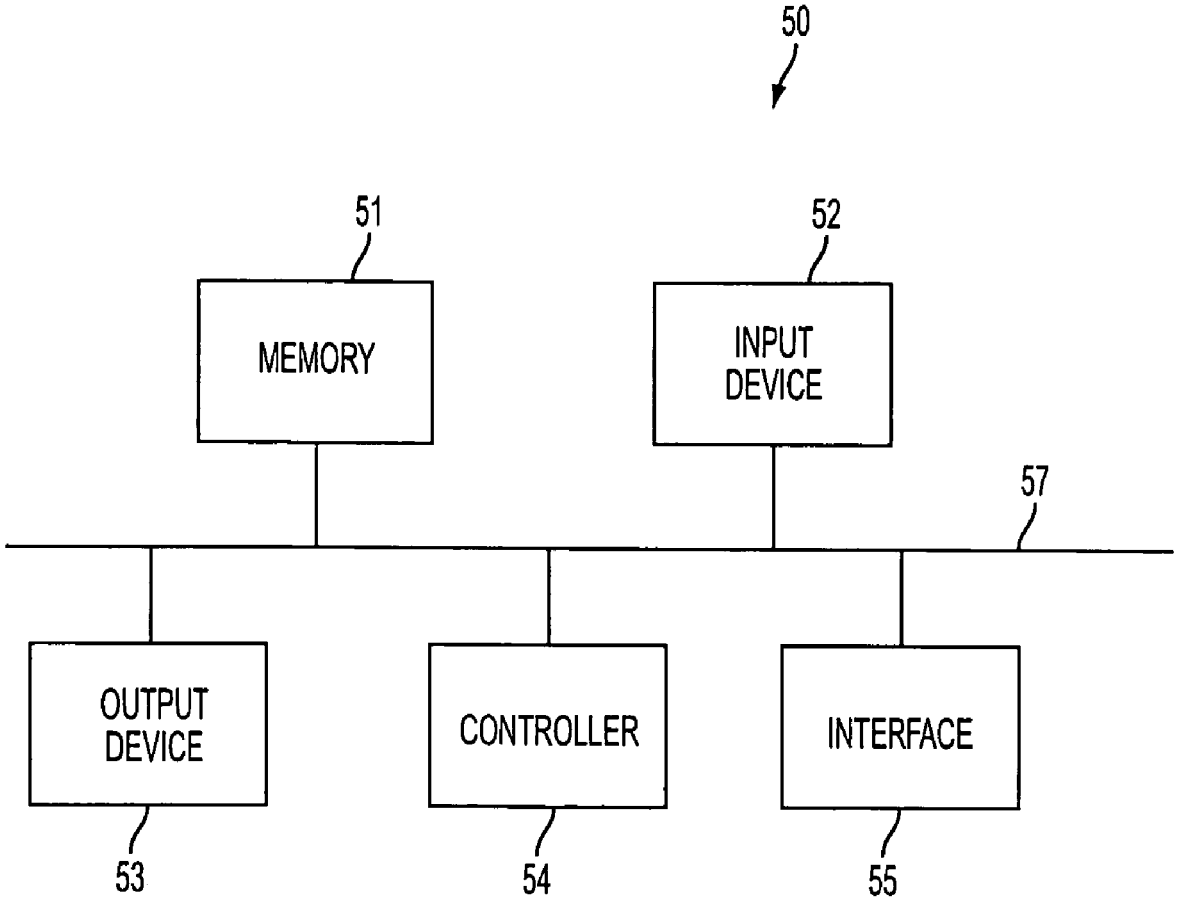
FIG. 10 is an exemplary detailed diagram of circuitry of a controller.

FIG. 10 is an exemplary detailed diagram of circuitry of a controlling device 50 that may be used to control a TRC as discussed in this disclosure. As shown in FIG. 10, the controlling device 50 may include a memory 51, an input device 52, an output device 53, a controller 54, and an interface 55. The devices 51-55 may be connected via a bus 57. The input device 52 may be any device that may allow commands to be inputted into the controlling device 50 so that it can control a printing system. The output device 53 may be any device that allows, for example, images to be recorded on a medium or shown on a display. The memory 51 may be any device that allows data or information to be stored. The interface 55 may allow the devices 51-55 to communicate with each other and with various devices within the printing system.

In the illustrated embodiment, the controller 54 may be implemented with a general-purpose processor. However, it will be appreciated by those skilled in the art that the controller 54 may be implemented using a single special purpose integrated circuit (e.g., ASIC, FPGA) having a main or central processor section for overall, system-level control, and separate sections dedicated to performing various different specific computations, functions and other processes under control of the central processor section. The controller 54 may be a plurality of separate dedicated or programmable integrated or other electronic circuits or devices (e.g., hardwired electronic or logic circuits such as discrete element circuits, or programmable logic devices such as PLDs, PLAs, PALs or the like). The controller 54 may be suitably programmed for use with a general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller 54. A distributed processing architecture can be used for maximum data/signal processing capability and speed.

Figure 11:
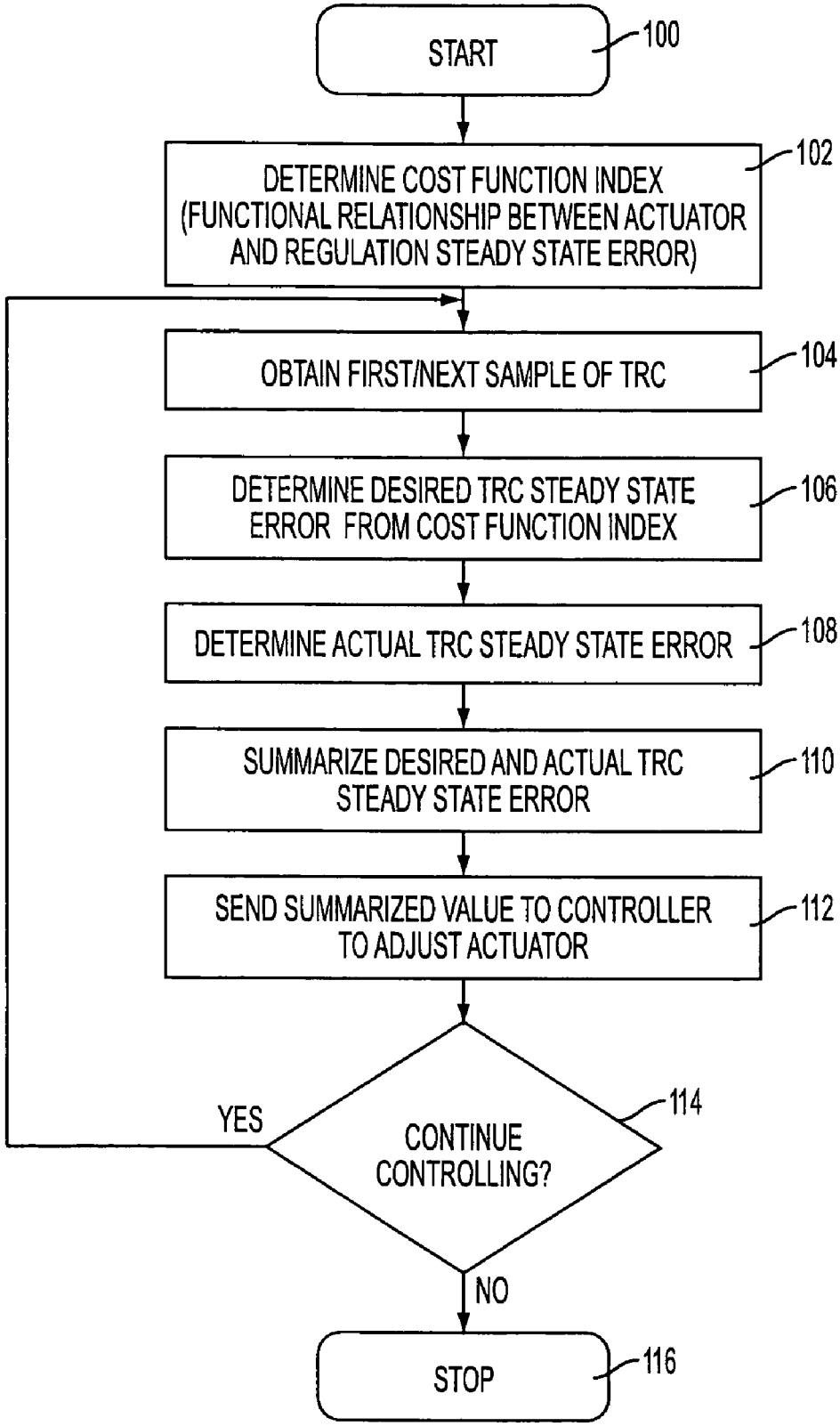
FIG. 11 is an exemplary flowchart showing an actuator method of controlling a TRC.

FIG. 11 is an exemplary flowchart showing an actuator method of controlling a TRC. The method is illustrated for a single input/single output system but is applicable to multi-input/multi-output systems. After control begins at step 100, control shifts to step 102 where a cost function index of an actuator value is determined based on a functional relationship between a tone reproduction curve error and the actuator value necessary to achieve a tone reproduction curve target. Then, in step 104, a first/next sample of the TRC is obtained. Next, in step 106, a desired TRC steady state error for the actuator setting at that instant is computed from the cost function index.

Control then shifts to step 108. In step 108, an actual TRC steady state error is determined from the sample. Next, in step 110, the desired TRC steady state error and the actual TRC steady state error are summarized. In step 112, the summarized value is sent to the controller to adjust the actuator. Control then shifts to step 114 where it determined if control will continue or if control will stop. Typically, control is on during printer operation and shuts down when the machine operation is stopped. If it is determined in step 112 that the actuator will continue to be controlled, then control shifts back to step 104 where steps 104-114 are repeated. Otherwise, control shifts from step 114 to step 116 where control stops.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of controlling an actuator for a printing system, comprising:

determining a function of an actuator value based on a cost function index that represents a relationship between a tone reproduction curve error and the actuator value necessary to achieve a tone reproduction curve target;

obtaining a sample of a tone reproduction curve;

determining an actual tone reproduction curve error from the obtained sample; and controlling the actuator based on the function and actual tone reproduction curve error to move to a point that represents the tone reproduction curve target.

2. The method of claim 1, comprising the tone reproduction curve error being a tone reproduction curve steady state error, and the cost function index being a tradeoff between a noise level and actuator value and defining an acceptable noise level at which the printing system can operate.

3. The method of claim 2, comprising the actuator value being a position of the actuator, and controlling the actuator to move to a plurality of points that represent a plurality of tone reproduction curve targets.

4. The method of claim 3, comprising controlling the actuator to move to the plurality of points until the actuator approaches an upper or lower physical limit of the actuator, and then adjusting the actuator to rapidly move toward an outermost limit of tone reproduction curve errors while maintaining the upper or lower physical limit of the actuator.

5. The method of claim 1, comprising determining a predetermined actuator value range within the upper and lower physical limits of the actuator, controlling the actuator to move to a plurality of points, and then move towards an outermost limit of tone reproduction curve errors after the actuator reaches a limit of the predetermined actuator value range.

6. The method of claim 1, comprising determining two different tone reproduction curve targets based on preset color calibrations for the printing system.

7. The method of claim 6, comprising controlling the actuator to move along a track defined by a plurality of points by switching the actuator between the two different tone reproduction curve targets depending on the actuator value.

8. The method of claim 1, wherein the tone reproduction curve error combines all mechanical variation, material variation, and environmental variation into a single variable aligned with an actuator response necessary to maintain the tone reproduction curve target.

9. The method of claim 1, comprising controlling the actuator using hysteresis to avoid instability in the actuator.

10. The method of claim 1, comprising the method of controlling the actuator being used on a Xerographic system to print an image on a receiving medium using a charge retentive surface.

11. A Xerographic system, comprising:

an actuator;

an input device that inputs a cost function index that represents a relationship between a tone reproduction curve error and an actuator value necessary to achieve a tone reproduction curve target; and a controller that controls the Xerographic system to obtain a sample of a tone reproduction curve, determine an actual tone reproduction curve error from the obtained sample, and control the actuator based on the cost function index and the actual tone reproduction curve error to move to a point that represents the tone reproduction curve target.

12. The Xerographic system of claim 11, comprising the tone reproduction curve error being a tone reproduction curve steady state error, and the cost function index being a tradeoff between a noise level and the actuator value and defining an acceptable noise level at which the printing system can operate.

13. The Xerographic system of claim 11, comprising the actuator value being a position of the actuator, and the controller controlling the actuator to move to a plurality of points that represent a plurality of tone reproduction curve targets.

14. The Xerographic system of claim 11, comprising the controller controlling the actuator to move to the plurality of points until the actuator approaches an upper or lower physical limit of the actuator, and then adjusting the actuator to rapidly move toward an outermost limit of tone reproduction curve errors while maintaining the upper or lower physical limit of the actuator.

15. The Xerographic system of claim 11, comprising the controller determining a predetermined actuator value range within the upper and lower physical limits of the actuator, controlling the actuator to move to a plurality of points, and then to move towards an outermost limit of tone reproduction curve errors after the actuator reaches a limit of the predetermined actuator value range.

16. The Xerographic system of claim 11, comprising the controller determining two different tone reproduction curve targets based on preset color calibrations for the printing system.

17. The Xerographic system of claim 16, comprising the controller controlling the actuator to move along a track defined by a plurality of points by switching the actuator between the two different tone reproduction curve targets depending on the actuator value.

18. The Xerographic system of claim 11, wherein the tone reproduction curve error combines all mechanical variation, material variation, and environmental variation into a single variable aligned with an actuator response necessary to maintain the tone reproduction curve target.

19. The Xerographic system of claim 11, comprising the controller controlling the actuator using hysteresis to avoid instability in the actuator.

20. The Xerographic system of claim 11, wherein the Xerographic system is used to print an image on a receiving medium using a charge retentive surface.

* * * * *